United States Patent [19]

Shirasaki et al.

[11] Patent Number: 4,929,503

[45] Date of Patent: May 29, 1990

[54] COMPOSITE FIBROUS MATERIAL

[75] Inventors: Yoshikazu Shirasaki; Yoshio Tadokoro, both of Shiga, Japan

[73] Assignee: Toyo Boseki Kabushiki Kaisha, Osaka, Japan

[21] Appl. No.: 943,002

[22] Filed: Dec. 18, 1986

[30] Foreign Application Priority Data

Dec. 19, 1985 [JP] Japan ..... 60-286750

[51] Int. Cl.[5] ..... D02G 3/00

[52] U.S. Cl. ..... 428/373; 428/224; 428/288; 428/364

[58] Field of Search ..... 428/296, 373, 374, 288; 57/231, 238, 248, 252, 253, 243

[56] References Cited

U.S. PATENT DOCUMENTS

| | | | |
|---|---|---|---|
| 4,240,486 | 12/1980 | Schmit et al. | 57/902 X |
| 4,276,348 | 6/1981 | Wu et al. | 57/243 |
| 4,407,885 | 10/1983 | Murphy et al. | 428/408 |
| 4,499,716 | 2/1985 | Antal et al. | 57/902 X |
| 4,681,792 | 7/1987 | Harpell et al. | 428/286 X |
| 4,737,402 | 4/1988 | Harpell et al. | 428/252 OR |
| 4,779,953 | 10/1988 | Ohta et al. | 428/375 |

*Primary Examiner*—Lorraine T. Kendell

*Attorney, Agent, or Firm*—Jones, Tullar & Cooper

[57] ABSTRACT

A composite fibrous material which comprises 50 to 95% by weight of (A) polyethylene fibers having high tenacity and tensile modulus and 5 to 50% by weight of (B) all aromatic polyamide fibers and/or (C) all aromatic polyester fibers, which has improved creep resistance and low shrinkage.

24 Claims, 2 Drawing Sheets

Figure 1:
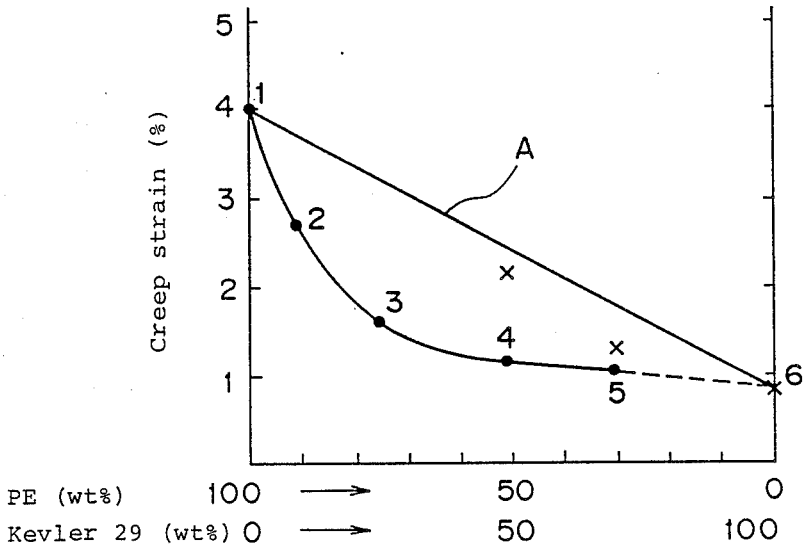

A: Additive value
x: Kevler 29 alone

A: Additive value
x: Kevler 29 alone

A: Additive value
x: Kevler 29 alone

A: Additive value

COMPOSITE FIBROUS MATERIAL

The present invention relates to a composite fibrous material. More particularly, it relates to a composite fibrous material of light weight having high tenacity (or tensile strength) and high tensile modulus as well as good resistance to light, abrasion and creep.

Synthetic fiber made ropes are made of, for example, polypropyrene, polyamide and polyester fibers. Recently, aromatic polyamide fiber with high tenacity and high tensile modulus (for example, KEVLAR, a trade mark of E. I. DuPont de Nemours & Co.) has been examined for use in the production of a rope having improved tenacity and a smaller diameter.

Steel wires have been replaced with all aromatic polyamide fiber so as to produce a non-rusting light-weight rope or a tension member for optical fiber cords or cables to prevent electromagnetic interference.

In all of the above technical fields, the all aromatic polyamide fiber has been increasingly used because of its unique properties which are not exerted by the conventional fibrous materials. However, the all aromatic polyamide fiber is expensive and does not necessarily have all required properties. For example, it lacks light resistance and abrasion resistance.

Therefore, a rope made of the all aromatic polyamide fiber is covered with a braid of polyester or polyamide fiber to impart light and abrasion resistance to the former. However, the braid of other fiber prevents detection of inner defects or damage to the rope It is known to use polyethylene fiber having high tenacity and high tensile modulus for the production of a rope or a tension member for optical fiber cords or cables (cf. Japanese Patent Publication (unexamined) Nos. 186688/1983, 139884/1985 and 138507/1985). The polyethylene fiber having high tenacity and high tensile modulus has been proposed as a material which overcomes the drawbacks of the all aromatic polyamide or polyester fiber since it is cheaper than them and has light weight, high tenacity, good abrasion resistance and chemical resistance. However, it still does not have enough creep resistance and low shrinkage to be required for the tension member although it has better creep resistance than conventional polyethylene or polypropylene. On the contrary, the all aromatic polyamide fiber satisfies creep resistance and low shrinkage required for the tensile member.

One object of the present invention is to provide a composite fibrous material having improved creep resistance and preferably low shrinkage while reserving all the preferred properties such as high tenacity, high tensile modulus, light weight, light resistance, abrasion resistance and chemical resistance which are attained by a fibrous material consisting of polyethylene fiber having high tenacity and tensile modulus.

This and other objects of the present invention are achieved by compositing polyethylene fiber having high tenacity and tensile modulus with other fiber having high tenacity, namely all aromatic polyamide fiber and/or all aromatic polyester fiber.

Accordingly, the present invention provides a composite fibrous material which comprises 50 to 95% by weight of (A) polyethylene fiber having high tenacity and tensile modulus and 5 to 50% by weight of (B) all aromatic polyamide fiber and/or (C) all aromatic polyester fiber.

Figure 2:
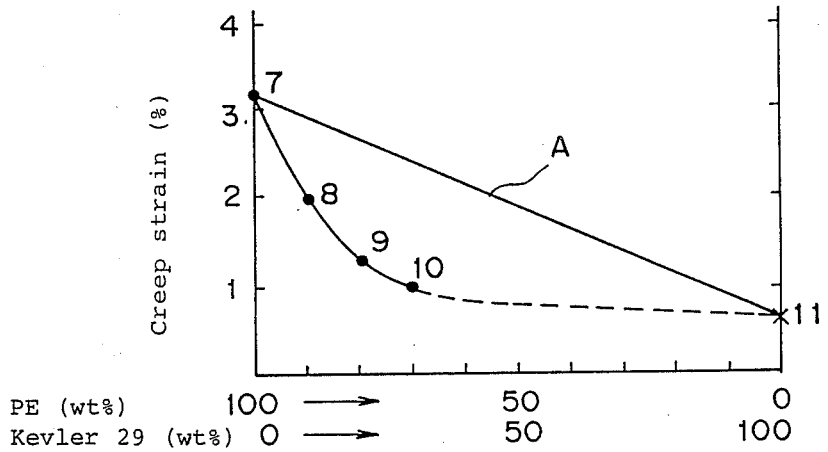
Figure 3:
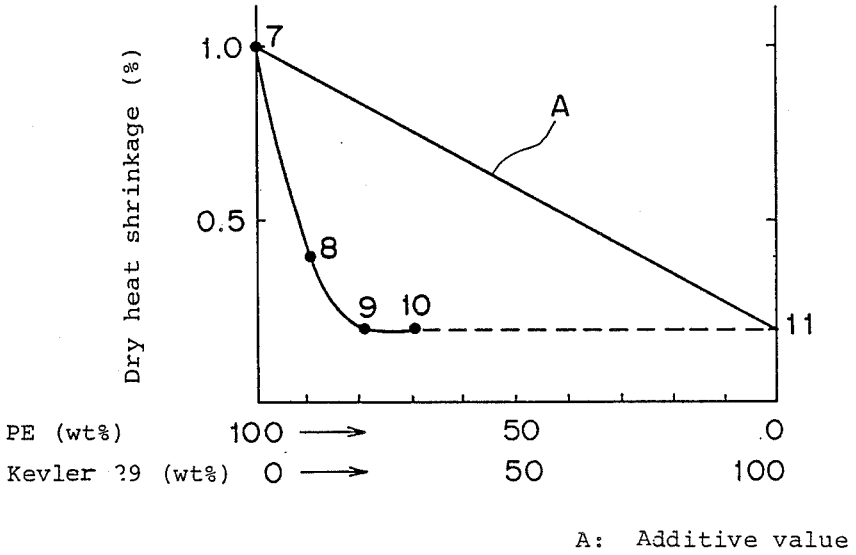

FIG. 1 is a graph showing a relationship between creep strain and weight ratios of polyethylene fiber and KEVLAR 29 fiber of the composite fiber bundles produced in Example 1, FIG. 2 is a graph showing a relationship between creep strain and weight ratios of polyethylene fiber and KEVLAR 29 fiber of the composite pultrusion rods produced in Example 2, and FIG. 3 is a graph showing a relationship between dry heat shrinkage and weight ratios of polyethylene fiber and KEVLAR 29 fiber of the composite pultrusion rods produced in Example 2.

In all the graphs, the upper straight lines stand for the additive values of creep strain or dry heat shrinkage of the polyethylene fiber and of KEVLAR 29.

The polyethylene fiber (A) having high tenacity and tensile modulus has tensile strength of at least 20 g/denier, preferably at least 30 g/denier and more preferably at least 40 g/denier, and tensile modulus of at least 500 g/denier, preferably at least 1,000 g/denier and more preferably at least 1,500 g/denier.

The upper limits of tenacity and tensile modulus of the polyethylene fiber (A) are not critical and the higher tenacity and tensile modulus, the better. In view of productivity of the fiber, the practical upper limits are 50 g/denier for tenacity and 2,000 g/denier for tensile modulus.

The all aromatic polyamide fiber (B) or the all aromatic polyester fiber (C) has tenacity of at least 15 g/denier, preferably at least 20 g/denier and more preferably at least 25 g/denier, and tensile modulus of at least 500 g/denier and preferably at least 1,000 g/denier.

The upper limits of the tenacity and tensile modulus of the fibers (B) and (C) are not critical and the higher tenacity and tensile modulus, the better. Again, in view of the productivity of the fibers, the practical upper limits are 35 g/denier for tenacity and 1,500 g/denier for tensile modulus.

When the polyethylene fiber (A) has tenacity of lower than 20 g/denier and tensile modulus of lower than 500 g/denier or when the all aromatic polyamide fiber (B) and/or polyester fiber (C) have tenacity of lower than 15 g/denier and tensile modulus of lower than 500 g/denier, a rope cannot be made thin enough and has poorer cost performance than one made of the conventional materials, and a cable or a tension member for an optical fiber not only becomes expensive but also does not satisfy the required physical properties.

Denier of a monofilament of the polyethylene fiber (A) is not critical and practically from 0.5 to 1,000 denier, particularly from 0.5 to 20 denier and preferably from 0.5 go 10 denier since in these ranges, the creep resistance of the composite fibrous material is significantly improved.

Denier of a monofilament of the all aromatic polyamide fiber (B) or polyester fiber (C) is not critical either and usually from 0.5 to 10 denier and preferably from 1 to 5 denier in view of improvement of abrasion resistance and flex resistance.

The composite fibrous material contains each fiber in the form of long fiber and may be of any composite viewed in the cross sectional form such as a side-by-side form, a sheath-core form and a mixing form.

The fiber in the composite fibrous material may also be impregnated with a resin. The resin to be impregnated includes unsaturated polyester resins, vinyl ester resins, epoxy resins, urethane acrylate resins, phenol resins and the like.

The composite fibrous material of the present invention may be a yarn, a doubled yarn, a strand, a braid, woven or non-woven fabric or a molded article cured with the resin by a pultrusion method.

The composite fibrous material contains the constituent fibers, namely the polyethylene fiber (A) and the aromatic polyamide fiber (B) and/or polyester fiber (C) in an amount of at least 50% by weight, preferably at least 60% by weight and more preferably at least 75% by weight. When the amount is less than 50% by weight, it is difficult to obtain any light-weight composite fibrous material having high tenacity and tensile modulus, good chemical and abrasion resistance and particularly improved creep resistance.

The composite fibrous material of the present invention may contain any other fiber in such an amount that the properties of the composite fibrous material are not impaired.

Specific examples of the all aromatic polyamide (B) are homo- and co-polymers of p-phenylene terephthalamide and the like.

Specific examples of the all aromatic polyester fiber (C) are homo- and co-polymers of p-phenylene terephthalate and the like.

To provide the light-weight composite fibrous material having improved creep resistance and low shrinkage without deteriorating high tenacity and tensile modulus and good light, abrasion and chemical resistance, the composite fibrous material of the present invention preferably contains 50 to 95% by weight, more preferably 60 to 85% by weight of the polyethylene fiber (A) and in turn preferably 50 to 5% by weight, more preferably 40 to 15% by weight of the all aromatic polyamide fiber (B) and/or the all aromatic polyester fiber (C).

When the content of the polyethylene fiber (A) is less than 50% by weight, the composite fibrous material becomes heavy and expensive and particularly has deteriorated light and abrasion resistance although creep resistance and low shrinkage are improved.

When the content of the polyethylene fiber (A) exceeds 95% by weight, creep resistance and low shrinkage of the composite fibrous material are not improved although high tenacity and tensile strength of the polyethylene fiber are not lost.

In one of preferred embodiments, the composite fibrous material comprises a core made of the aromatic polyamide fiber (B) and a sheath made of the polyethylene fiber (A) since such composite form minimizes deterioration of light and abrasion resistances.

Among the effects achieved by compositing the polyethylene fiber (A) and the all aromatic polyamide fiber (B) and/or the all aromatic polyester fiber (C), the cost reduction and the weight saving are proportional to the weights of the fibers, that is, they are additive properties.

Surprisingly, improvement of creep resistance and low shrinkage of the composite fibrous material of the invention are synergistic particularly in a range in which the all aromatic polyamide fiber (B) and/or the all aromatic polyester fiber (C) composited with the polyethylene fiber (A) is less than 50% by weight.

If fiber other than the all aromatic polyamide or polyester fiber (B) or (C), for example, polyamide (Nylon) fiber which has lower tensile modulus by one order than the polyethylene (A) is composited with the polyethylene fiber (A), it cannot bear creep load so that an improved creep resistance cannot be expected.

The present invention will be explained further in detail with reference to the following examples wherein part(s) and % are by weight unless otherwise indicated. In the examples, the physical characteristics of the composite fibrous materials produced were measured in the following manner:

(1) Characteristics of strength and elongation:

Determined according to the method of JIS (Japan Industrial Standard) L-1013 (1981). Using a tensilon (manufactured by Toyo-Baldwin), an S—S curve was obtained under the conditions: sample length, 200 mm; cross head rate, 100 mm/min. Tensile strength, tensile modulus and elongation at break were calculated from the S—S curve. Tensile modulus was calculated from the maximum slope near the starting point of the S—S curve.

(2) Creep resistance:

Two marks separated by a predetermined distance ($L_0$) were made on a test piece with applying initial load of 0.1 g/denier and the piece was kept standing at room temperature for 120 days while applying a predetermined load (20% of tensile strength at break). Thereafter, the distance (L) between the two marks was measured and creep strain (%) was calculated according to the following equation:

$$\text{Creep strain} = \frac{L - L_0}{L_0} \times 100\ (\%)$$

(3) Shrinkage after dry heating:

Two marks separated by a distance of 100 cm were made on a test piece while applying initial load of 0.1 g/denier and the piece was dry heated at 100° C. for 150 hours without applying any load. Thereafter, the distance (L) between the two marks was measured while applying a load of 0.1 g/denier and dry heat shrinkage was calculated according to the following equation:

$$\text{Creep strain} = \frac{L - 100}{100} \times 100\ (\%)$$

(4) Abrasion resistance:

(a) Abrasion resistance of a yarn was measured according to the method of JIS L 1095, 7.10.2 by applying abrasive action to the yarn with a tester for measuring combining force of spun yarn under load of 0.15 g/denier. Abrasion resistance was evaluated by the number of cycles when the yarn was broken.

(b) Abrasion resistance of fabric was measured according to the method of JIS L 1096, 6.17.A-2 (the flex method).

EXAMPLE 1

Polyethylene having a viscosity-average molecular weight of $1\times10^6$ and flexible polymer chains was dissolved in decalin at a polymer concentration of 5% to prepare a spinning stock solution. The stock solution kept at a temperature at which the solution did not solidify (about 160° C.) was extruded through a spinneret into the air of room temperature to cool it to form gel like filaments. The gel like filaments containing decalin were, without evaporation of decalin therefrom, drawn at a draw ratio of 30 at such temperature that the filaments were not fused. Thus produced polyethylene fiber had the following characteristics:

| | |
|---|---|
| Total denier: | 150 denier |
| Number of filaments: | 120 |
| Tenacity: | 33.8 g/denier |
| Elongation at break: | 2.9% |
| Initial modulus: | 1,590 g/denier |

Characteristics of commercially available aromatic polyamide (KEVLAR 29 manufactured by E. I. Du-Pont de Nemours & Co.) to be composited with polyethylene were as follows:

| | |
|---|---|
| Total denier: | 200 denier |
| Number of filaments: | 134 |
| Tenacity: | 21.2 g/denier |
| Elongation at break: | 2.9% |
| Initial modulus: | 740 g/denier |

Polyethylene fibers and KEVLAR 29 fibers were composited in a ratio as shown in Table 1 to form a composite fiber bundle, which was subjected to the creep resistance test under the following conditions;

| | |
|---|---|
| Temperature: | Room temperature |
| Load: | 20% of tensile strength at break |
| Duration: | 120 days |

Creep strain and density of each composite fiber bundle are shown in Table 1 and FIG. 1.

TABLE 1

| | Run No. | | | | | |
|---|---|---|---|---|---|---|
| | 1 | 2 | 3 | 4 | 5 | 6 |
| Total denier of high tenacity polyethylene before composite | 1,800 | 1,800 | 1,200 | 1,050 | 600 | 0 |
| Total denier of Kevlar 29 before composite | 0 | 200 | 400 | 1,000 | 1,400 | 2,000 |
| Total denier of composite fiber bundle | 1,800 | 2,000 | 1,600 | 2,050 | 2,000 | 2,000 |
| Weight ratio of PE/Kevlar 29 | 100/0 | 90/10 | 75/25 | 51/49 | 30/70 | 0/100 |
| Load A*1 (kg) | 12.1 | 13.1 | 9.8 | 11.3 | 10.0 | 8.5 |
| Strength at break of Kevlar 29 before composite (kg) | — | 4.2 | 8.5 | 21.2 | 29.7 | 42.4 |
| Creep strain of composite fiber (%) | 4.0 | 2.7 | 1.6 | 1.2 | 1.1 | 0.85 |
| Creep strain of Kevlar 29 fiber before composite under Load A (%) | — | *2 | *2 | 2.2 | 1.25 | 0.85 |
| Density of composite fiber bundle ($g/cm^3$) | 0.98 | 1.01 | 1.07 | 1.17 | 1.27 | 1.45 |

Note
*1 20% of tensile strength at break of the composite fiber bundle.
*2 Broken just after the load was applied.

EXAMPLE 2

By the pultrusion method, a pultrusion rod comprising a core made of KEVLAR 29 and a sheath made of high tenacity polyethylene fiber prepared in Example 1 in a composite ratio as shown in Table 2 was produced under following conditions:

| | |
|---|---|
| Resin composition: | |
| Urethane acrylate resin: | 100 parts |
| Benzoyl peroxide (50% paste): | 2 parts |
| Pultrusion conditions: | |
| Curing temperature: | 125° C. |
| Curing time: | 2 min. |
| Fiber volume content: | 50% |
| Rod diameter: | 1.6 mm |

Creep resistance and dry heat shrinkage of each rod were measured. The results are shown in Table 2 and FIGS. 1 and 2.

TABLE 2

| | Run No. | | | | |
|---|---|---|---|---|---|
| | 7 | 8 | 9 | 10 | 11 |
| Total denier of high tenacity polyethylene before composite | 9,000 | 8,100 | 7,500 | 6,900 | 0 |
| Total denier of Kevlar 29 before composite | 0 | 1,000 | 2,000 | 3,000 | 13,000 |
| Total denier of composite fiber | 9,000 | 9,100 | 9,500 | 9,900 | 13,000 |
| Weight ratio of PE/Kevlar 29 | 100/0 | 89/11 | 79/21 | 70/30 | 0/100 |
| Load B*1 (kg) | 55 | 53 | 53 | 53 | 50 |
| Strength at break of rod made of Kevlar 29 alone (kg) | — | 21 | 42 | 63 | 248 |
| Creep strain of composite rod (%) | 3.2 | 2.0 | 1.3 | 1.0 | 0.6 |
| Dry heat shrinkage of composite rod (%) | 1.0 | 0.4 | 0.2 | 0.2 | 0.2 |
| Density of composite rod ($g/cm^3$) | 1.09 | 1.11 | 1.13 | 1.15 | 1.33 |

Note
*1 20% of tensile strength of the composite rod.

EXAMPLE 3

In the same manner as in Example 1 but using all aromatic polyester fiber in place of KEVLAR 29, composite fiber bundles were produced in weight ratios of the fibers as shown in Table 3.

The aromatic polyester fiber used in this example was Ekonol (manufactured by Sumitomo Chemical Company, Limited) having following properties:

| | |
|---|---|
| Total denier: | 880 denier |
| Monofilament denier: | 4.6 denier |

-continued

| | |
|---|---|
| Tenacity: | 19.5 g/denier |
| Elongation at break: | 2.3% |
| Tensile modulus: | 790 g/denier |

Creep resistance of the composite fiber bundles is shown in Table 3.

TABLE 3

| | Run No. | |
|---|---|---|
| | 12 | 13 |
| Total denier of high tenacity polyethylene before composite | 2,100 | 0 |
| Total denier of Ekonol before composite | 880 | 1,760 |
| Total denier of composite fiber bundle | 2,980 | 1,760 |
| Weight ratio of PE/Ekonol | 70/30 | 0/100 |
| Load A*1 | 17.6 | 6.9 |
| Creep strain of composite fiber bundle | 1.60 | 0.90 |
| Density of composite fiber bundle (g/cm$^3$) | 1.11 | 1.41 |

Note
*1See Note *1 of Table 1.

EXAMPLE 4

By warping high tenacity and tensile modulus polyethylene fiber (75 denier) and KEVLAR 29 fiber (1,000 denier) alternately and using polyester fiber (1,000 denier) as weft, a twill weave fabric having a width of 5 cm was woven.

For comparison, twill weave fabric having the same width was woven from warps of high tenacity and tensile modulus polyethylene (750 denier) or of KEVLAR 29.

Properties of the fabrics are shown in Table 4.

TABLE 4

| | Run No. | | | | | |
|---|---|---|---|---|---|---|
| | 14 | | 15 | | 16 | |
| Warp | | | | | | |
| Material | PE | Kevlar 29 | PE | Kevlar 29 | PE | Kevlar 29 |
| Number of yarns | 150 | — | 100 | 50 | — | 150 |
| Weft | | | | | | |
| Material | PES | | PES | | PES | |
| Number of yarns | 10 | | 10 | | 10 | |
| Denier | | | | | | |
| Warp | 750 | — | 750 | 1,000 | — | 1,000 |
| Weft | 1,000 | | 1,000 | | 1,000 | |
| Weave | Twill | | Twill | | Twill | |
| Weight ratio of PE/Kevlar 29 | 100/0 | | 60/40 | | 0/100 | |
| Creep resistance | Δ | | ○-◎ | | ◎ | |
| Abrasion resistance*1 | ◎-○ | | ○ | | X | |

Note*1
◎ : Excellent
○: Good
Δ: Poor
X: Bad

As is seen from the results of Example 1 (Table 1 and FIG. 1), creep resistance of the composite fiber bundle of high tenacity and tensile modulus polyethylene fiber and all aromatic polyamide fiber (KEVLAR 29 in Example 1) is improved without deteriorating excellent properties of high tenacity and tensile modulus polyethylene fiber. Particularly, the values of creep resistance of the composite fiber bundle having the preferred composite ratio (Run Nos. 2–4) were more greatly decreased than expected from the additive values of creep resistance of both fibers.

In Run Nos. 2 and 3, KEVLAR 29 fiber alone was broken just after application of load corresponding to 20% of tensile strength of the composite fiber.

In Run No. 4, while creep strain of KEVLAR 29 fiber alone was 2.2%, it decreased to 1.2% when it was composited with high tenacity and tensile modulus polyethylene.

As is apparent from the results in Example 2 (Table 2 and FIG. 2), the pultrusion rod molded from composite of high tenacity and tensile modulus polyethylene with all aromatic polyamide fiber and a resin had not only improved creep resistance but also improved low shrinkage, namely lower dry heat shrinkage.

That is, when 30% by weight of KEVLAR 29 fiber was composited (Run No. 10), creep strain was decreased to about one third of that of the rod molded from high tenacity and tensile modulus polyethylene alone (Run No. 7).

Further, as is clear from Table 2 and FIG. 3, the pultrusion rod comprising high tenacity and tensile modulus polyethylene and a small amount of KEVLAR 29 had greatly improved dry heat shrinkage.

In Example 3, by compositing all aromatic polyester fiber (Ekonol) with high tenacity and tensile modulus polyethylene, the comparable results to those of Example 1 were obtained.

Example 4 illustrates the excellent effects of the present invention where the composite fibrous material is of fabric form. As is apparent from Table 4, woven fabric of Run No. 15 comprising polyethylene fiber and KEVLAR 29 fiber had improved creep resistance in comparison with that of polyethylene alone and also improved abrasion resistance in comparison with the fabric comprising warp of 100% KEVLAR 29 fiber.

According to the present invention, it is possible to impart improved creep resistance and low shrinkage to the composite fibrous material without deteriorating good physical properties of the high tenacity and tensile modulus polyethylene such as light weight, light resistance, abrasion resistance and chemical resistance.

Particularly, the degree of improvement of creep resistance attained by the composite fibrous material is more than a mere additive value of creep resistance of each constituent fibers, namely the high tenacity and tensile modulus polyethylene (A) and the all aromatic polyamide fiber (B) and/or the all aromatic polyester (C).

The composite fibrous material according to the present invention may be used in any technical field where high tenacity, high tensile modulus, creep resistance and weight saving of material are required. The composite fibrous material according to the present invention is used for the production of not only a rope, a cable and a tension member for an optical fiber or cable but also a tension member used in other fields, a racket gut, a bow string.

What is claimed is:

1. A bundle of fibers which comprises 50 to 95% by weight of (A) polyethylene fibers having a tenacity of at least 20 g/denier and a tensile modulus of at least 500 g/denier, 5 to 50% by weight of (B) all aromatic polyamide fibers and (C) all aromatic polyester fibers, wherein the all aromatic polyamide fibers (B) and the all aromatic polyester fibers (C) have a tenacity of at least 15 g/denier and a tensile modulus of at least 500 g/denier.

2. The bundle of fibers according to claim 1, which comprises 60 to 85% by weight of the polyethylene fibers (A), and 40 to 15% by weight of the all aromatic polyamide fibers (B) and the all aromatic polyester fibers (C).

3. The bundle of fibers according to claim 1, wherein a monofilament of the polyethylene fibers (A) has a denier of 0.5 to 20.

4. The bundle of fibers according to claim 1, wherein a monofilament of the all aromatic polyamide fibers (B) and the all aromatic polyester fibers (C) have a denier of 0.5 to 10.

5. The bundle of fibers according to claim 1, which is in the form of a strand.

6. A bundle of fibers which comprises 50 to 95% by weight of (A) polyethylene fibers having a tenacity of at least 20 g/denier and a tensile modulus of at least 500 g/denier and 5 to 50% by weight of (C) all aromatic polyester fibers, wherein the all aromatic polyester fibers (C) have a tenacity of at least 15 g/denier and a tensile modulus of at least 500 g/denier.

7. The bundle of fibers according to claim 6, which comprises 60 to 85% by weight of the polyethylene fibers (A) and 40 to 15% by weight of the all aromatic polyester fibers (C).

8. The bundle of fibers according to claim 6, wherein a monofilament of the polyethylene fibers (A) has a denier of 0.5 to 20.

9. The bundle of fibers according to claim 6, wherein a monofilament of the all aromatic polyester fibers (C) has a denier of 0.5 to 10.

10. The bundle of fibers according to claim 6, which is in the form of a strand.

11. The bundle of fibers according to claim 1, wherein the polyethylene fibers (A) have a tenacity of at least 30 g/denier.

12. The bundle of fibers according to claim 1, wherein the polyethylene fibers (A) have a tenacity of at least 40 g/denier.

13. The bundle of fibers according to claim 1, wherein the polyethylene fibers (A) have a tensile modulus of at least 1000 g/denier.

14. The bundle of fibers according to claim 1, wherein the polyethylene fibers (A) have a tensile modulus of at least 1500 g/denier.

15. The bundle of fibers according to claim 1, wherein the all aromatic polyamide fibers (13) and the all aromatic polyester fibers (C) have a tenacity of at least 20 g/denier.

16. The bundle of fibers according to claim 1, wherein the all aromatic polyamide fibers (B) and the all aromatic polyester fibers (C) have a tenacity of at least 25 g/denier.

17. The bundle of fibers according to claim 1, wherein the all aromatic polyamide fibers (B) and the all aromatic polyester fibers (C) have a tensile modulus of at least 1000 g/denier.

18. The bundle of fibers according to claim 6, wherein the polyethylene fibers (A) have a tenacity of at least 30 g/denier.

19. The bundle of fibers according to claim 6, wherein the polyethylene fibers (A) have a tenacity of at least 40 g/denier.

20. The bundle of fibers according to claim 6, wherein the polyethylene fibers (A) have a tensile modulus of at least 1000 g/denier.

21. The bundle of fibers according to claim 6, wherein the polyethylene fibers (A) have a tensile modulus of at least 1500 g/denier.

22. The bundle of fibers according to claim 6, wherein the all aromatic polyester fibers (C) have a tenacity of at least 20 g/denier.

23. The bundle of fibers according to claim 6, wherein the all aromatic polyester fibers (C) have a tenacity of at least 25 g/denier.

24. The bundle of fibers according to claim 6, wherein the all aromatic polyester fibers (C) have a tensile modulus of at least 1000 g/denier.

* * * * *